US005904020A

United States Patent [19]

Carlson et al.

[11] Patent Number: 5,904,020

[45] Date of Patent: May 18, 1999

[54] TRANSLUCENT CONSTRUCTION BLOCK ASSEMBLY

[75] Inventors: Marlon Carlson; Julian Carlson, both of Beaumont, Calif.

[73] Assignee: Hy-Lite, Inc., Parkersburg, W. Va.

[21] Appl. No.: 09/007,200

[22] Filed: Jan. 14, 1998

[51] Int. Cl.[6] ..... E04C 1/42

[52] U.S. Cl. ..... 52/308; 52/89; 52/306; 52/770; 52/780; 52/781

[58] Field of Search ..... 52/89, 306, 308, 52/770, 780, 781

[56] References Cited

U.S. PATENT DOCUMENTS 4,891,925 1/1990 Carlson et al. ..... 52/306 X 5,687,521 11/1997 Carlson et al. ..... 52/308

*Primary Examiner*—Christopher Kent

*Attorney, Agent, or Firm*—Cesari and McKenna, LLP

[57] ABSTRACT

A translucent construction block assembly, e.g. for a window or wall panel of non-standard size and/or shape, has a frame extending around an array of hollow translucent construction blocks assembled in horizontal and vertical juxtaposition, the blocks each having front and rear walls connected by a peripheral wall and the array having a periphery engaged by the frame so that the blocks are thereby retained in position. The blocks include partial blocks having openings interrupting the peripheral walls thereof, the partial blocks being juxtaposed with the openings at the periphery of the array. A seal of resilient material interposed between the array and the frame extends between the front and rear walls and closes the openings.

5 Claims, 5 Drawing Sheets

TRANSLUCENT CONSTRUCTION BLOCK ASSEMBLY

BACKGROUND OF THE INVENTION

1. Field of the Invention

The present invention relates to a translucent construction block assembly and, more particularly, to an assembly of translucent construction blocks held together in horizontal and vertical juxtaposition by a frame to form, for example, a window, a panel or a wall.

2. Description of the Related Art

In the U.S. Pat. No. 4,891,925, issued Jan. 9, 1990, to Marlon Carlson et al., the disclosure of which is incorporated herein by reference, there is disclosed a construction block of translucent plastic material comprising a generally rectangular hollow body having a pair of faces, or front and rear walls joined by side edges, or peripheral walls, with spanning members engageable in cavities in the blocks for connecting the blocks into a unified wall structure. This prior patent also discloses the use of an alignment strip which interfits with the blocks for aligning the blocks.

It is also known to assemble blocks such as those disclosed in the above-mentioned U.S. Pat. No. 4,891,925 into a rectangular array and to hold the thus-assembled blocks in position relative to one another by means of a frame, formed of aluminum extrusion, which extends around the block assembly.

The assembly may then be employed as, for example, a window, a wall panel or free-standing wall.

However, a problem arises when it is desired, for aesthetic reasons, to provide the assembly with an arch-shaped top, since suitably curved translucent construction blocks may not be available.

BRIEF SUMMARY OF THE INVENTION

According to the present invention, a translucent construction block assembly comprises an array of hollow translucent construction blocks assembled in horizontal and vertical juxtaposition, the blocks each having front and rear walls, and a peripheral wall connecting the front and rear walls, and a frame extending around the array. The array has a periphery engaged by the frame and the translucent construction blocks and thereby retained in position relative to one another in the array by the frame. At least some of the translucent construction blocks are partial blocks and the partial blocks have openings interrupting the peripheral walls thereof, the partial blocks being juxtaposed with the openings located at the periphery of the array. A seal of resilient material interposed between the periphery of the array and the frame extends between the front and rear walls of the partial blocks and closes the openings in the peripheral walls of the partial blocks.

By means of the present invention, readily available translucent construction blocks of standard size and of rectangular shape can be cut to provide the partial blocks with e.g. curved peripheries for forming an arch-shape or other curved shape or to form blocks of other non-standard shapes and sizes, e.g. triangular or small rectangular blocks.

The seal is preferably made of a foam material.

In a preferred embodiment of the invention, the frame includes front and rear flanges extending inwardly of the array around the periphery of the array, with the periphery of the array and the seal located between and thereby concealed by the front and rear flanges.

BRIEF DESCRIPTION OF THE DRAWINGS

The invention will be more readily understood from the following description thereof when taken in conjunction with the accompanying drawings, in which.

DESCRIPTION OF THE PREFERRED EMBODIMENTS

Figure 1:
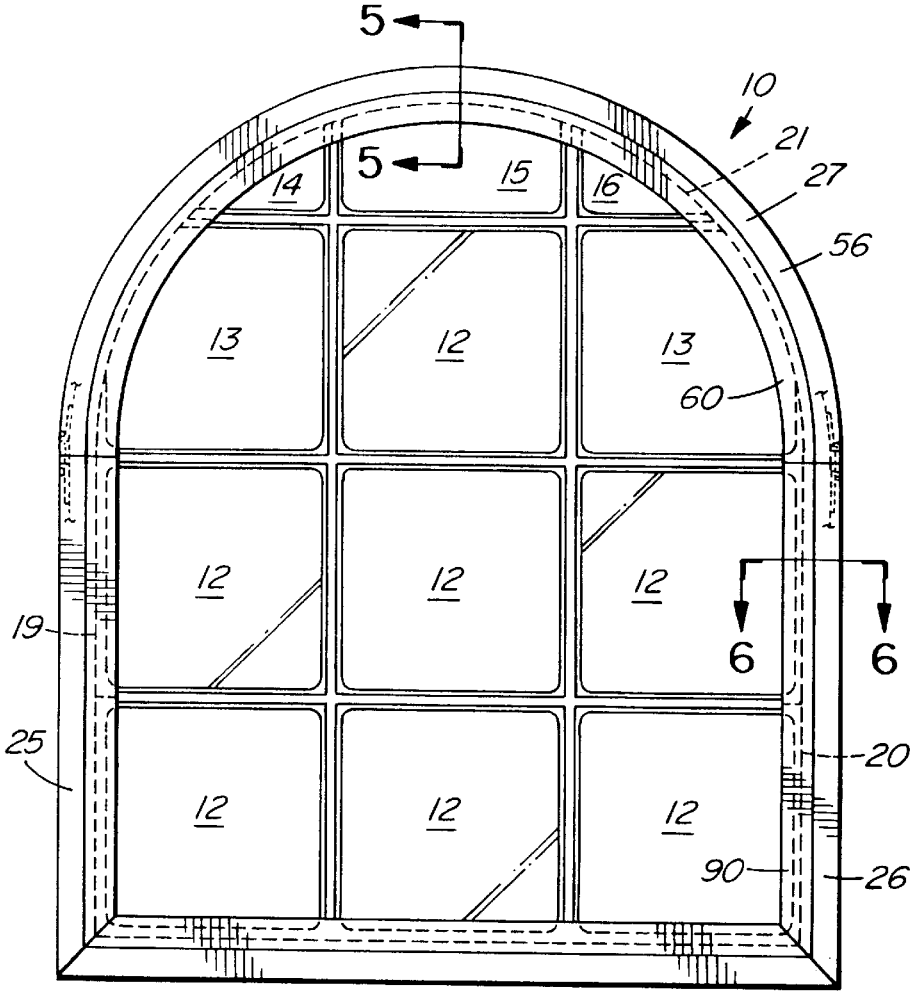
FIG. 1 shows a view in front elevation of an arch-shaped window according to the present invention.

In FIG. 1, there is shown a window which is indicated generally by reference numeral 10 and which comprises horizontally and vertically juxtaposed complete and partial translucent construction blocks, of which the complete blocks are indicated by reference numerals 12 and the partial blocks are indicated by reference numerals 13 through 16. The blocks 12 through 16 form an array of blocks which has a periphery including a straight, horizontal bottom portion 18, straight vertical side portions 19 and 20 and an arch-shaped top peripheral portion 21, the partial blocks 13 through 16 being horizontally laterally, i.e. juxtaposed at the top of the array.

A frame extends around the periphery of the translucent block array and serves to hold the blocks 12 through 16 in position relative to one another. This frame comprises a straight horizontal bottom portion 24, which extends along the bottom portion 18 of the block array; straight vertical side portions 25 and 26, which extend along the straight vertical portions 19 and 20 of the array; and a curved, arch-shaped top portion 27, which extends around the arch-shaped top portion 21 of the array. The frame portions 24 through 27 comprise metal extrusions which are connected together, at abutting ends thereof, as described in greater detail below.

Figure 6:
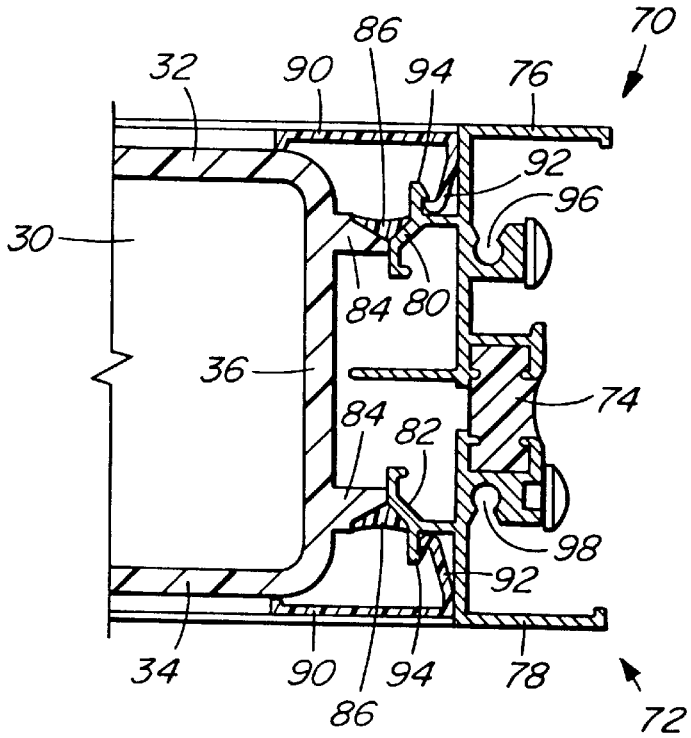
FIG. 6 shows a view taken in horizontal cross-section along the line 6—6 of FIG. 1.

The translucent blocks 12 through 16 each have a hollow interior 30 defined by a front wall 32, a rear wall 34 and a peripheral wall 36, and their peripheral walls 36 extend around the respective blocks between the peripheries of the front and rear walls 32 and 34 as shown in FIG. 6.

In the case of the complete blocks 12, the peripheral walls 36 extend around the entire peripheries of each block 12.

Figure 3:
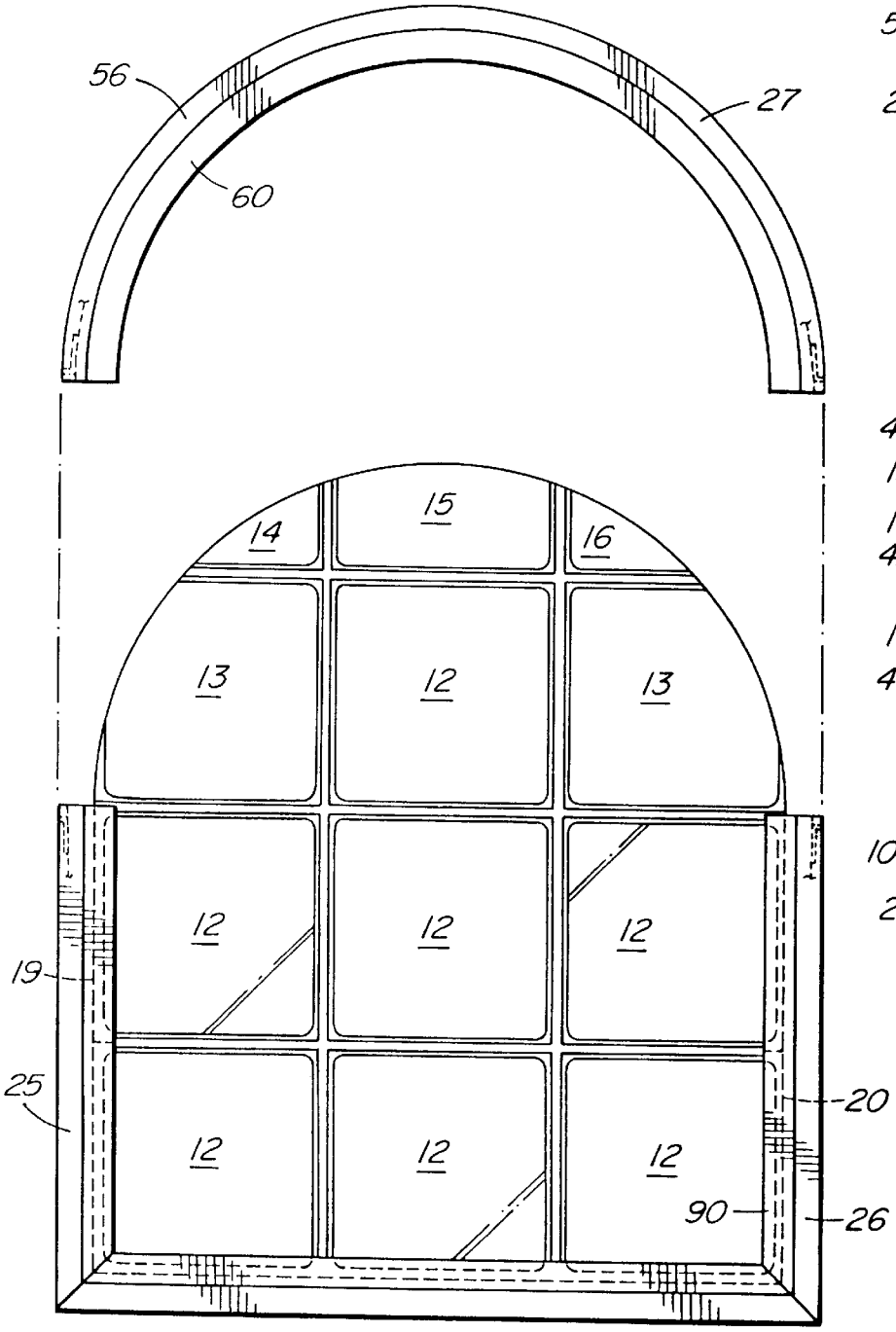
FIG. 3 shows a view in front elevation of the window of FIG. 1, but with an arch-shaped frame portion shown spaced from the remainder of the window.
Figure 4:
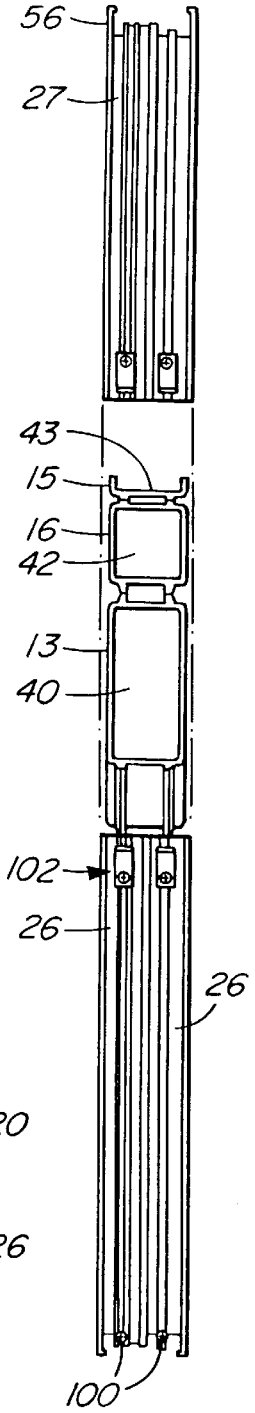
FIG. 4 shows a view in side elevation of the window of FIG. 3.

The partial blocks 13 through 16, however, are cut away so as to form the arch-shaped top portion 21 of the block array. Thereby, a portion of the peripheral wall 36, and the front and rear walls 32 and 34, of each of the blocks 13 through 17 is removed along almost the entirety of the arch-shaped top portion 21 of the array, as can be seen in FIG. 3, so as to form openings 40, 42 and 43 interrupting the peripheral walls 36 of the blocks 13 through 16.

These openings are closed by a strip of resilient foam material 46 (FIG. 5) which is interposed between the arch-shaped top portion 27 of the frame and the arch-shaped top portion 21 of the block array.

Figure 5:
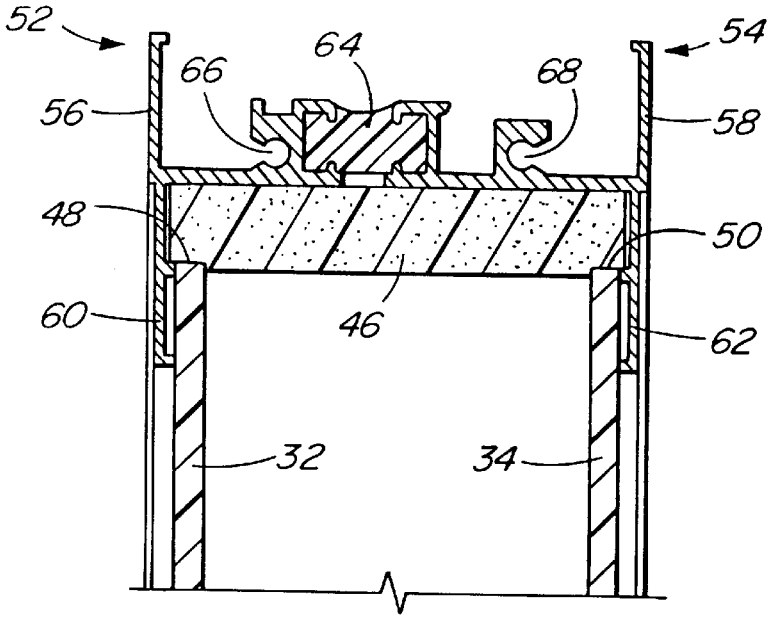
FIG. 5 shows a view taken in vertical cross-section along the line 5—5 of FIG. 1.

More particularly, as shown in FIG. 5, the foam material strip is interposed between cut edges 48 and 50 of the front and rear walls 32 and 34 of the blocks 13 through 16, adjacent the openings 40, 42 and 43, with the resilient foam strip 46 bridging the spacings between the edges 48 and 50 and, thereby, closing the openings 40,42 and 43. The cut edges 48 and 50 are curved in conformity with the arch-shaped top portion.

As is also shown in FIG. 5, the arch-shaped top portion 27 of the frame is formed of two metal extrusions, indicated generally by reference numerals 52 and 54, and has upstanding front and rear flanges 56 and 58 and depending front and rear flanges 60 and 62. The flanges 60 and 62 project inwardly of the array of blocks, around the arch-shaped portion 21. The arch-shaped peripheral portion 21 of the block array, and also the resilient foam strip 46, are received between and, thereby, concealed from view by the front and rear depending flanges 60 and 62.

The extrusions 52 and 54 are connected by a thermal stop material 64 and are formed with cylindrical openings 66 and 68, the purpose of which is described below.

The bottom portion 24 and the side portions 25 and 26 of the frame are each formed of two extrusions, which are indicated generally by reference numerals 70 and 72 in FIG. 6, and which are connected together by thermal stop material 74.

The extrusions 70 and 72 are formed with outwardly projecting front and rear flanges 76 and 78, which are co-planar with the flanges 56 and 58 of the extrusions 52 and 54 shown in FIG. 5. Also, the extrusions 70 and 72 are formed with inwardly projecting flanges 80 and 82 which, as can be seen from FIG. 6, serve as abutments for outwardly extending projections 84 formed on the peripheral walls 36 of the blocks. A sealant 86 is provided, as shown, on the flanges 80 and 82 and the projections 84 so as to seal the blocks 12 to the frame.

Concealing strips 90 are provided to conceal gaps between the peripheries of the block front and rear walls 32 and 34 and the extrusions 70 and 72. The strips 90, which are made of resilient plastic material are each formed with a flange 92 which can be pressed into snap-action engagement with a flange 94 or 96, the flanges 94 and 96 being provided on the extrusions 70 and 72, respectively.

Figure 2:
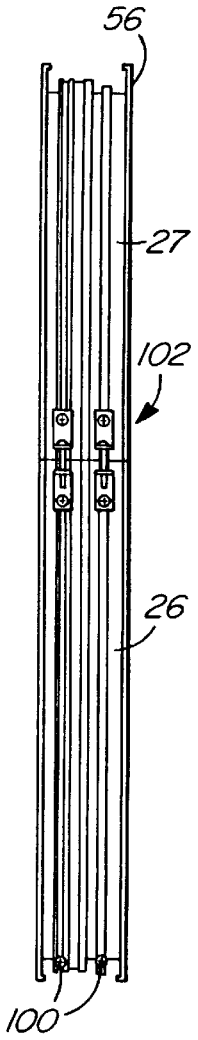
FIG. 2 shows a view in side elevation of the window of FIG. 1.

The extrusions 70 and 72 are also formed with cylindrical recesses 96 and 98 to enable the bottom portion 24 of the frame to be secured to the side portions 25 and 26 by means of screws 100 (FIG. 2) inserted into threaded engagement in the openings 96 and 98.

Figure 7:
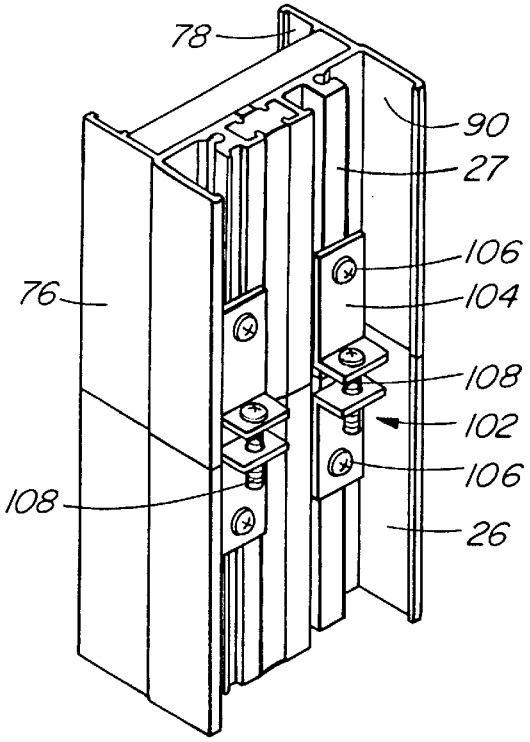
FIGS. 7, 8 and 9 show broken-away views, in perspective, of three different connections between parts of a window frame.

The arch-shaped top portion 27 of the frame is secured to the side portions 25 and 26 by means of connectors indicated generally by reference numeral 102. In the present embodiment of the invention, the connectors 102, as shown in greater detail in FIG. 7, each comprise two pairs of L-shaped clips 104 secured by screws 106 to the frame portions 25 through 27 and connected together by securing screws 108.

Figure 8:
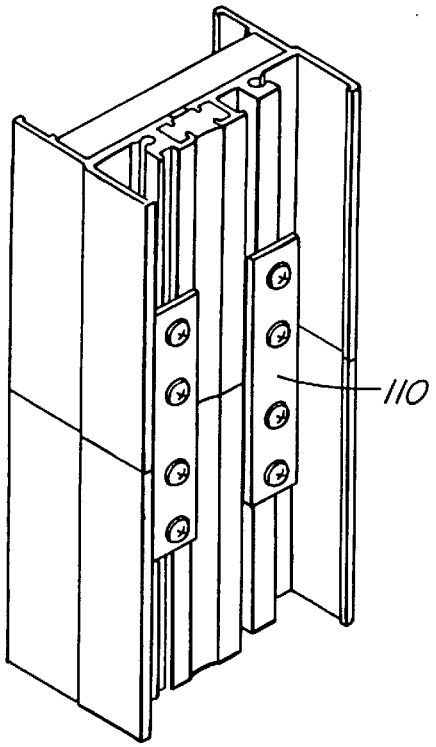
Figure 9:
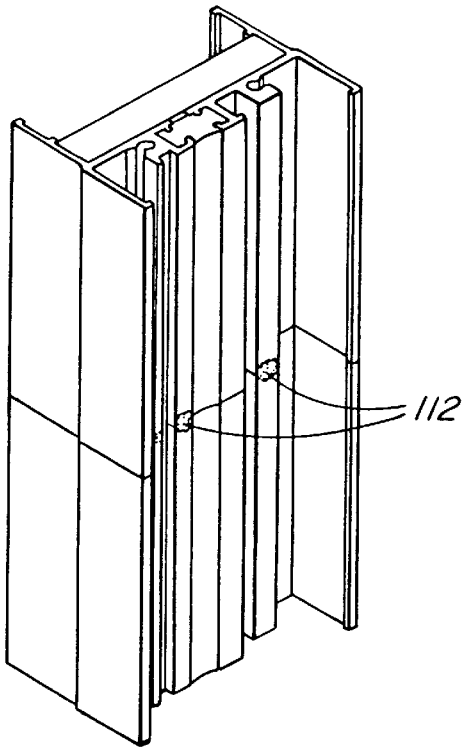

Alternatively, the top frame portion 27 may be secured to the side portions 25 and 26 by means of flat-plate ties 110 as shown in FIG. 8, or by means of concealed tack welds 112, as illustrated in FIG. 9.

Figure 10:
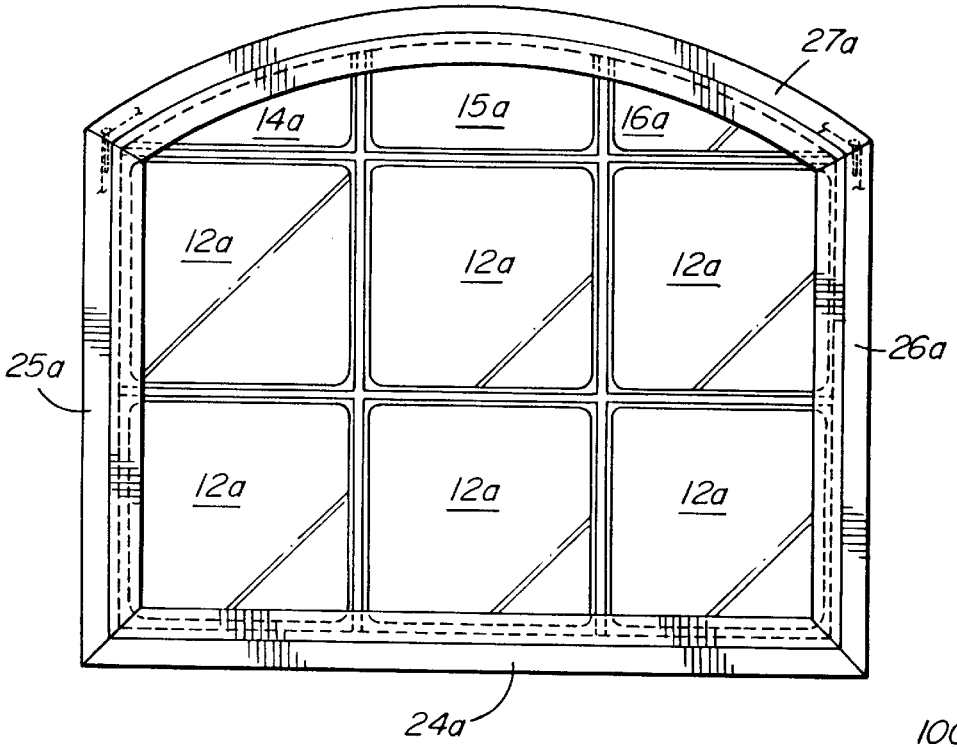
FIGS. 10 and 11 show views corresponding to those of FIG. 1 and 2 but of a modified window according to the present invention.
Figure 11:
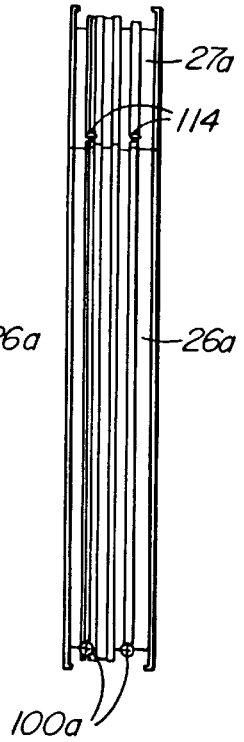

If, however, the curvature of the top portion of the frame is sufficiently large, as illustrated for example by the frame top portion 27*a* of FIGS. 10 and 11, then the frame top portion 27*a* may be secured to the side portions of the frame by means of screws 114.

In FIGS. 10 and 11, components which correspond to those of FIGS. 1 through 7 and indicated by corresponding reference numerals with the suffix "a" and, for convenience, are not described in further detail herein. It will be apparent, however, that the screws 115 are in threaded engagement with cylindrical openings (not shown), corresponding to the openings 94 and 98 of FIG. 6 but forme din frame side portions 25*a* and 26*a* of FIG. 10.

As will be apparent to those skilled in the art, various modifications may be made to the above-described block assemblies within the scope of the invention as defined by the appended claims.

For example, the invention is not restricted to arch-shaped block arrays but may, for example, be embodied in rectangular arrays. This may be useful, for example, for adapting rectangular blocks of standard dimensions to fit non-standard window frames by cutting some or all of the blocks to form rectangular partial blocks.

Another possibility is to provide curved partial blocks the entire periphery of the block array, which may in that case be of e.g. circular or oval shape.

All of the blocks in the array may be partial blocks having interrupted peripheral walls.

We claim:

1. A translucent construction block assembly, comprising:

an array of hollow translucent construction blocks assembled in horizontal and vertical juxtaposition;

said blocks each having front and rear walls, and a peripheral wall connecting said front and rear walls;

a frame extending around said array;

said array having a periphery engaged by said frame and said translucent construction blocks thereby being retained in position relative to one another in said array by said frame;

at least some of said translucent construction blocks being partial blocks and said partial blocks having openings interrupting said peripheral walls thereof;

said partial blocks being juxtaposed with one another and with said openings located at said periphery of said array; and a seal of resilient material interposed between the periphery of said array and said frame;

said seal extending between said front and rear walls of said partial blocks and closing said openings in said peripheral walls of said partial blocks.

2. A translucent construction block assembly as claimed in claim 1, wherein said frame is curved and said front and rear walls of said partial blocks have edges adjacent said openings, said edges being curved in conformity with said frame.

3. A translucent construction block assembly as claimed in claim 2, wherein said frame includes an arch-shaped top portion and said partial blocks are juxtaposed at the top of said array at said arch-shaped top portion of said frame.

4. A translucent construction block assembly as claimed in claim 1, wherein said resilient material comprises a foam material.

5. A translucent construction block assembly as claimed in claim 1, wherein said frame includes front and rear flanges extending inwardly of said array around said periphery of said array, said periphery of said array and said seal being located between and thereby concealed by said front and rear flanges.

* * * * *